United States Patent [19]

Coeurderoy

[11] 3,963,135

[45] June 15, 1976

[54] METHOD OF SUBORDINATING THE ORIENTATION OF A GRAB ON A PUBLIC WORKS MACHINE TO THE ROTATION OF THE TURREST OF THIS MACHINE AND TO THE MACHINE

[75] Inventor: Yves G. Coeurderoy, Lagny-le-Sec, France

[73] Assignee: Societe Anonyme: Poclain, Le-Plessis-Belleville, France

[22] Filed: Nov. 12, 1974

[21] Appl. No.: 523,148

[30] Foreign Application Priority Data

Nov. 21, 1973 France ..... 73.41494

[52] U.S. Cl. ..... 214/151; 212/50; 214/1 BC; 214/152

[51] Int. Cl.[2] ..... B65G 47/90

[58] Field of Search ..... 214/1 CM, 1 BC, 1 BD, 214/1 BH, 1 BV, 151, 762, 769, 763, 764, 152, 147 R, 147 T, 147 G; 212/50

[56] References Cited

UNITED STATES PATENTS

| | | | |
|---|---|---|---|
| 2,770,141 | 11/1956 | Dinsmore | 214/1 BC X |
| 3,007,097 | 10/1961 | Shelley et al. | 214/1 BC X |
| 3,337,071 | 8/1967 | Clark | 214/151 X |
| 3,698,580 | 10/1972 | Carlson et al. | 214/1 CM X |
| 3,840,128 | 10/1974 | Swoboda, Jr. et al. | 214/763 X |
| 3,880,304 | 4/1975 | Strickland, Jr. | 214/1 CM X |

FOREIGN PATENTS OR APPLICATIONS

| | | | |
|---|---|---|---|
| 6,703,879 | 9/1968 | Netherlands | 214/1 BC |

*Primary Examiner*—Frank E. Werner
*Attorney, Agent, or Firm*—Lewis H. Eslinger; Alvin Sinderbrand

[57] ABSTRACT

In a method of subordinating the orientation of a grab on a Public Works machine to the angle of rotation of the turret three directions are chosen, the first two being determined by the desired orientation of the grab in the loading and unloading zones, respectively, and the third passing through the axis of rotation of the turret 2, the angle of rotation of the turret starting from the third direction is measured and compared with the angle between a straight line, passing through the point of intersection of the first two directions and the axis of rotation of the turret, makes and the third direction, the desired angle of the grab with respect to the boom in the loading or unloading zones is determined and the angle that the grab actually makes with the boom is measured and compared with the appropriate desired angle, the results of this comparison being used to control rotation of the grab to reduce the difference to zero.

8 Claims, 4 Drawing Figures

FIG. 1
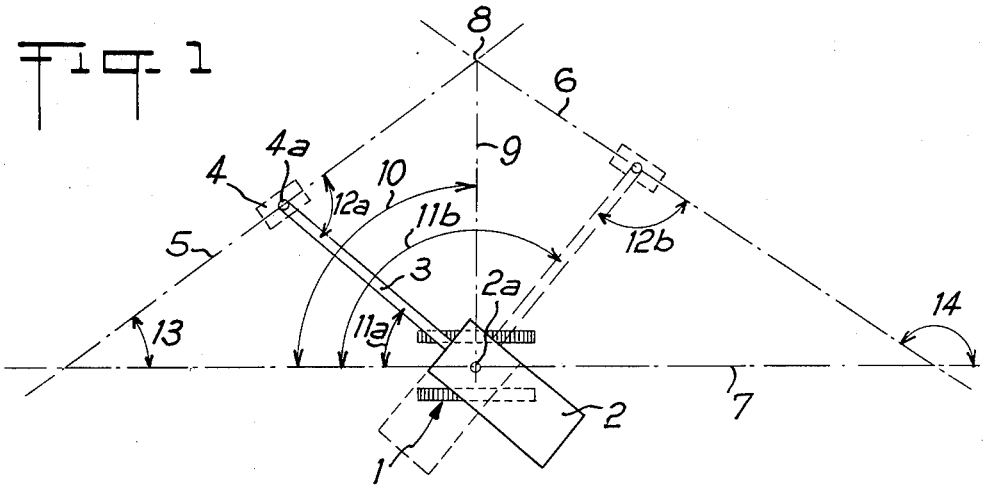
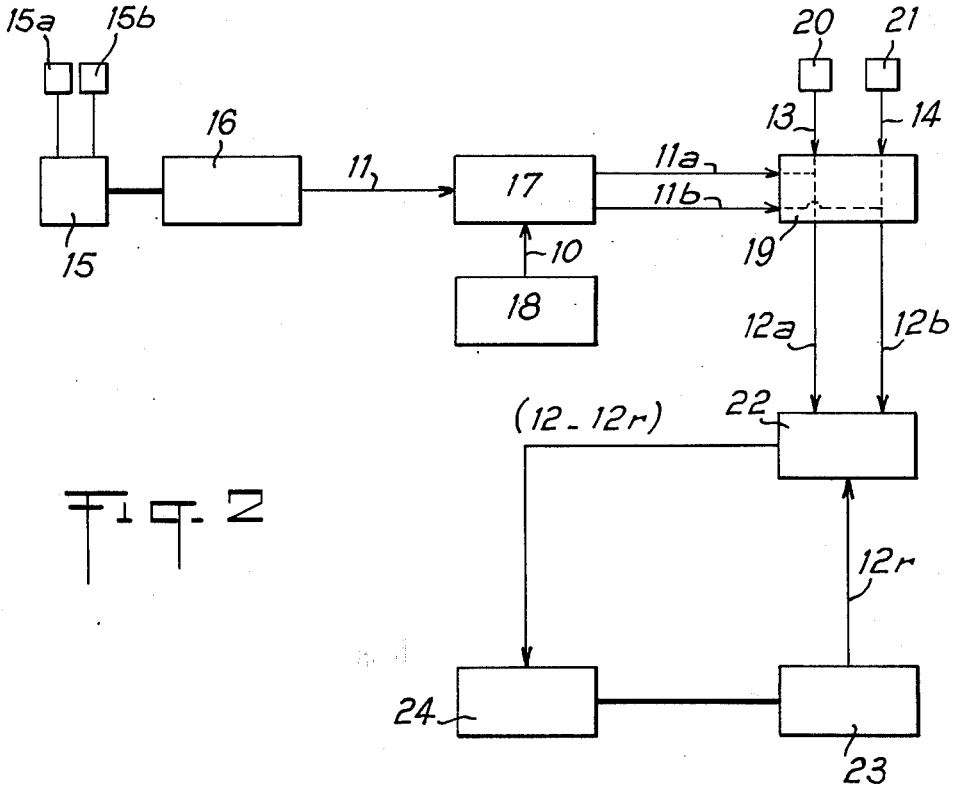
FIG. 2

FIG. 3
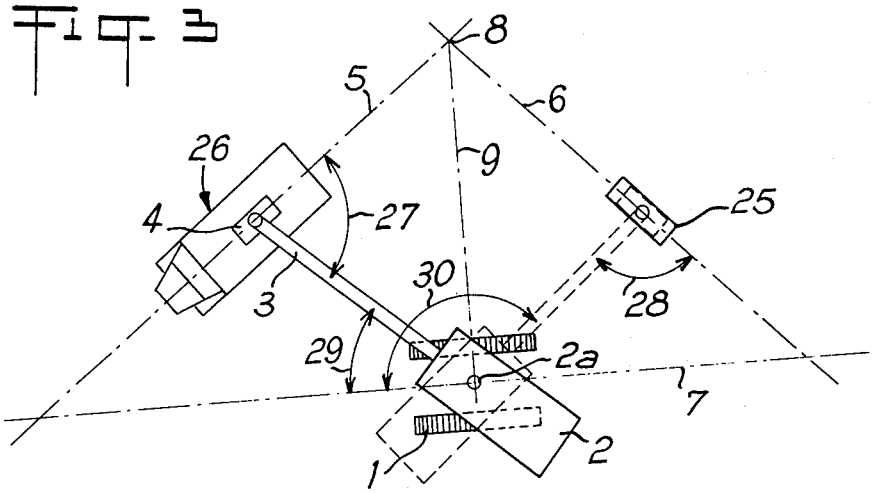
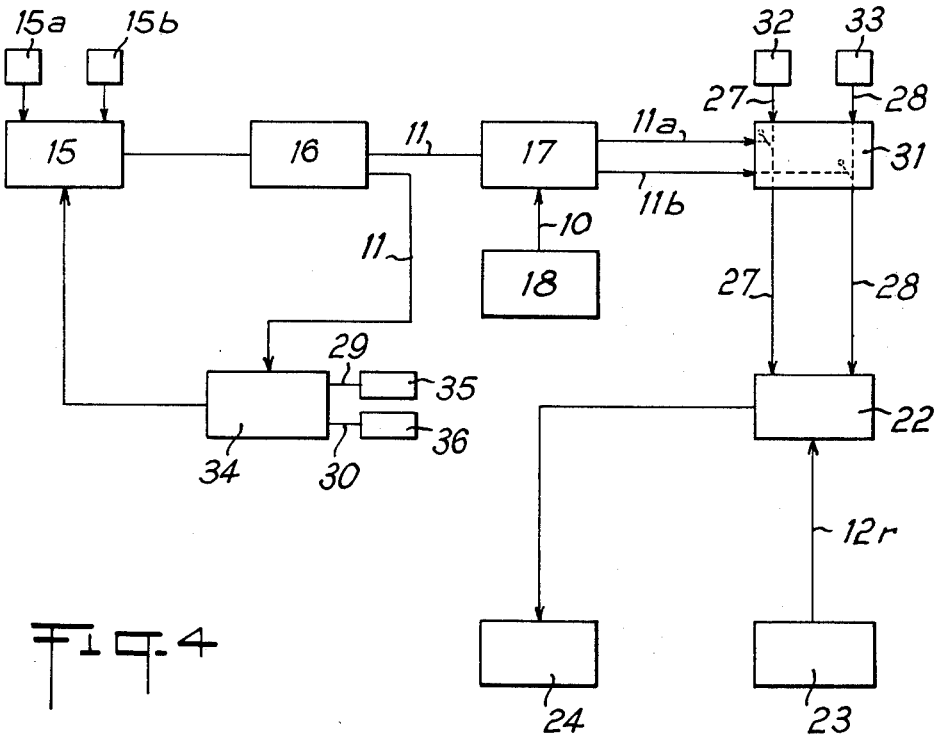
FIG. 4

METHOD OF SUBORDINATING THE ORIENTATION OF A GRAB ON A PUBLIC WORKS MACHINE TO THE ROTATION OF THE TURREST OF THIS MACHINE AND TO THE MACHINE

The present invention relates to a method of subordinating the orientation of a grab on a Public Works machine to the rotation of the turret of this machine and to the machine.

One job of transferring material by means of a handling or Public Works machine consists in taking this material up at one place and depositing it at another place. When the work is carried out by means of a grab it is necessary for this to have one orientation in order that taking up of the material is correct and another orientation in order that the unloading of the material is likewise correct. In known machines adjustment of the orientation is effected manually at the points of loading and unloading, for every operation. This is particularly the case when digging a trench: the grab must always present itself with the same orientation at the trench in order to be able to dig it correctly, and at the material removal lorry or truck it must be orientated along the axis of the latter in order that filling of the lorry or truck is satisfactory. It is not often possible to present the lorry or truck at an angle such that the grab, in its digging orientation, is correctly presented with respect to the said lorry. The orientation of the grab must therefore be changed at every movement of the turret. This operation is a disadvantage in known devices because it wastes time and therefore lowers the overall performance of the machine.

The present invention proposes to reduce these disadvantages by subordinating the orientation of the grab to the rotation of the turret of the machine as a function of the relative locations of the loading and unloading zones and the axis of rotation of the turret, so as to enable presentation of the grab at said zones in constant orientations.

In a method of subordination according to the invention three directions are chosen, the first direction being determined by the desired orientation of said grab in said loading zone, the second direction being determined by the desired orientation of said grab in said unloading zone, and the third direction passing through the axis of rotation of said turret, next the angle of rotation of said turret is measured starting from said third direction in order to compare it with the angle between said third direction and a straight line passing through the point of intersection of said first and second directions and said rotation axis of said turret, next the angles which it is desired that said grab should make, with respect to said boom in said loading and unloading zones, is determined, and finally the angle which said grab actually makes with said boom is measured in order to compare it with said desired angle, the results of this comparison being used to control rotation of said grab with respect to said boom to reduce said actual angle to said desired angle.

In a first embodiment particularly applicable to loading and unloading zones which are elongate in the first and second directions respectively, the angle which said grab is to take up with respect to said boom in said loading and unloading zones is determined by summation of the angle of rotation of said turret and the angle between said first or second direction respectively and said third direction in dependence on the results of the comparison of the angle of rotation of said turret with the angle between said third direction and said straight line passing through the axis of rotation of said turret and the point of intersection of said first and second directions.

In a second embodiment, applicable particularly to point loading and unloading zones, the desired angle which said grab must make with said boom is determined by selecting its value from at least two values which are predetermined as a function of the results of the comparison of the angle of rotation of said turret with the angle between said third direction and said straight line passing through the axis of rotation of said turret and the point of intersection of said first and second directions.

In this embodiment rotation of said turret is advantageously limited to a sector bounded by the two angles that said boom makes with said third direction when said grab is in said loading and unloading zones.

Preferably the third direction coincides with the main axis of said machine.

In a Public Works machine according to the invention for transferring material from a loading zone extending substantially along a first direction to an unloading zone extending substantially along a second direction, and comprising a frame, a turret mounted for rotation on the frame, a boom supported on the said turret and carrying at its free end a grab which is mounted for rotation on the boom, drive means of rotating the turret with respect to the frame, and drive means for rotating the grab with respect to the boom, there is provided:

- a first pick-up means for generating a signal corresponding to the angle of rotation of said turret with respect to a third direction chosen arbitrarily in the working plane of said machine and passing through the axis of rotation of said turret,
- means for generating a signal corresponding to the value of the angle between said third direction and a straight line passing through the point of intersection of said first and second directions and said axis of rotation of said turret,
- a first element for comparing said signal from said first pick-up means with said generated signal and being adapted to emit selectively one of two signals as a result of said comparison,
- means for generating two signals of predetermined value, the first signal corresponding to the desired angle of orientation of said grab with respect to said boom at said loading zone, the second signal corresponding to the desired angle of orientation of said grab with respect to said boom at said unloading zone,
- a selector connected to said two signal generating means for emitting a signal selected from said two signals as a function of the value of the signal which it receives from said first comparator element,
- a second pick-up means for emitting a signal corresponding to the angle of orientation of said grab with respect to said boom,
- a second element for comparing the signal from said selector and said second pick-up means and emitting a signal for controlling said drive means for rotating said grab with respect to said boom so as to nullify the difference between the two signals which said second element compares.

A first embodiment includes means for generating two signals corresponding to the minimum and maximum values of the angle of rotation of said turret measured from said third direction, and a third element for comparing the signal emitted by said first pick-up means with said two signals and for emitting a signal for controlling said drive means for rotating said turret as a function of the results of said comparison.

In a second variant, particularly for use with elongate loading and unloading zones said selector comprises a logic calculator connected to the outputs of said first comparator element and to signal generating means for generating two signals, said first signal corresponding to the angle between said first and third directions, the second signal corresponding to the angle between said second and third directions, said calculator selecting one of said two signals as a function of the signal from said first comparator element and emitting an output signal corresponding to the sum of said selected one of said two signals and said signal received from said first comparator element.

The invention will be better understood from the following description of an embodiment thereof, given by way of example only, with reference to the accompanying drawing, in which:

FIG. 1 is a diagrammatic plan view of an embodiment of a machine in accordance with the invention, particularly for use with elongate loading and unloading zones;

FIG. 2 is a synoptic diagram of the various stages of a method in accordance with the invention of use of the machine of FIG. 1;

FIG. 3 is a diagrammatic plan view of another embodiment of a machine in accordance with the invention, particularly for use with point loading and unloading zones; and FIG. 4 is a synoptic diagram of the various phases of a method in accordance with the invention of use of the machine of FIG. 3.

The machine illustrated in FIG. 1 comprises a frame 1, a turret 2 mounted to rotate about an axis 2*a* on the frame 1, a boom 3 hinged on the turret 2 and a grab 4 mounted to rotate about an axis 4*a* on the boom 3. The boom may be telescopic or equipped with an equalizer. The straight line 5 indicates the direction of a loading zone and the straight line 6 indicates the direction of an unloading zone. It can, for example, be imagined that the straight line 5 is the axis of a trench to be dug by means of the grab 4, and that the straight line 6 is the axis of the track of a train of spoil-removal trucks. It can therefore be seen that whatever the working point chosen on the straight line 5 and the straight line 6 it is necessary that the orientations of the grab should coincide with the direction 5 and with the direction 6. The straight line 7 indicates any direction passing through the axis of rotation 2*a* of the turret 2. Preferably a direction will be chosen which is identical as in FIG. 1 with the main axis of the machine or the frame 1. The two straight lines 5 and 6 intersect at a point 8. The straight line 9, passing through this point and the axis 2*a*, defines with the straight line 7 a characteristic angle 10. In fact when the boom 3 manoeuvres within this angle the grab 4 is at the level of the loading zone 5 and when the boom 3 manoeuvres outside this angle the grab 4 is at the level of the unloading zone 6. It is quite obvious that in an extreme case of the straight lines 5 and 6 being parallel, the straight line 9 would be parallel to them.

The angle of rotation of the turret is measured starting from the straight line 7 and is referenced 11*a* if it is smaller than the angle 10 and 11*b* if it is greater than this angle.

The orientation of the grab is indicated by the angle that it makes with the boom 3, and is referenced 12*a* in the loading zone and 12*b* in the unloading zone. This angle is of course variable as a function of the value of the angle 11. If the angle between the two straight lines 5 and 7 is referenced 13, and the angle between the two straight lines 6 and 7 is referenced 14, it can be written that the angle 12*a* is equal to the sum of the two angles 13 and 11*a* and k.180°, *k* being positive or negative and that the angle 12*b* is equal to the sum of the two angles 14 and 11*b* and k.180°.

It can be seen that by comparing the angle 11 with the angle 10 one can determine which is the one of the two aforesaid equations which must be used in subordinating the orientation of the grab 4 to the rotation of the turret 3.

In FIG. 2 there is shown diagrammatically a member 15 for driving the turret 2 in rotation, with 15*a* and 15*b* being its left and right control devices at the disposal of the driver. An angle of rotation of pick-up 16 for the angle 11 is coupled to this driving member 15 and is capable of delivering at its output a signal proportional to the value of this angle. This signal is compared in a first comparator element 17 with a signal delivered by an adjustable selector 18, which signal is proportional to the measured or defined angle 10. The comparator element 17 enables the angle 11 to be identified as 11*a* or 11*b*. The output signal from the comparator 17 therefore identifies the angle 11 and is sent to the appropriate one of two inputs of a calculator 19 enabling the carrying out of either the sum of the angle 11*a* and the angle 13 or the sum of the angle 11*b* and the angle 14. Signals corresponding to the angles 13 and 14 are introduced into the calculator 19 by means of two selectors 20 and 21. These two selectors are adjustable by the driver so as to provide signals to the calculator 19, proportional to the measured or defined angles 13 and 14.

Depending upon the value 11*a* or 11*b* that the calculator 19 receives at its input, it emits at one of its outputs a signal corresponding to the angle 12*a* or 12*b* calculated using one or other of the aforesaid equations. Thus a signal is obtained which is proportional to the angle of orientation of the grab 4 with respect to the boom 3 which is required. This signal is introduced into a second comparator element 22 which also receives a signal from an angle of rotation pick-up 23 coupled to member 24 for driving the grab 4 in rotation relative to the boom 3. This signal is significant of the actual angle 12*r* that the grab 4 makes with the boom 3. The comparator element 22 performs the comparison between the two signals it receives and emits a signal for so controlling the driving member 24 of the grab 4 that the actual orientation of the grab 12*r* becomes identical with the desired angle 12*a* or 12*b*. It will have been observed that on FIG. 2 the references are provided against the outputs of the various components indicating the quantities to which the various signals emitted are proportional.

By the above method of subordination one has achieved the maintainance of the orientation of the grab 4 parallel to the direction 5 or the direction 6. Every time the driver presents the grab at one of the loading or unloading zones it will be in an optimum position for carrying out the required operation. The result is a gain in time for carrying out a transfer of material and therefore an improvement in the overall performance of the machine.

FIG. 3 illustrates a Public Works machine in the course of digging a ditch 25 and transferring the material from the ditch to a lorry 26. It will be seen that in this operation the loading zone and the unloading zone of the grab 4 are precisely located, and are in fact pin-points and orientated along the directions represented by the lines 5 and 6.

It is therefore sufficient if the grab 4 can take up two orientations fixed with respect to the boom 3 and corresponding respectively to the angles 27 and 28 in FIG. 3 and the rotation of the turret is limited to the angular sector bounded by the angles 28 and 29.

The circuitry for such an operation is shown diagrammatically in FIG. 4. In it are shown certain of the components described with reference to FIG. 2 and these components have the same references. In this Figure the calculator 19 has been replaced by a selector 31 controlled by the output signal from the comparator 17, and which is capable of delivering at one of its outputs a signal corresponding to the value of the angle which it is desired that the grab 4 should take up with respect to the boom. The selector 31 operates to choose as a function of the signal emitted by comparator 17 one or other of two predetermined signals corresponding to the angles 27 and 28, which are introduced into it by means of manual adjustment members 32 and 33. The output signal from the selector 31 next undergoes the same treatment as the output signal from the calculator 19 of FIG. 2 to control the adjustment of the orientation of the grab 4 by action on its driving member 24.

It will likewise be observed that the signal emitted by the pick-up 16 is supplied to a comparator element 34 in which the angle 11 of rotation of the turret 2 is compared with signals corresponding to the two limiting values 29 and 30 of this angle as defined in FIG. 3. The values of these two limiting signals are predetermined by means of manual adjustment members 35 and 36 the outputs of which are connected to the input of the comparator 34. The comparator 34 supplies a signal to the member 15 for maintaining the rotation of the turret if the angle 11 lies between the angles 29 and 30 or for the stopping this rotation if the angle 11 is equal to one or other of the angles 29 and 30. The references against the outputs of the components have the same significance as those in FIG. 2.

It is therefore seen that the above described subordination means enables the orientation of the grab 4 when presented to the ditch 25 or the lorry 26 to be the same for each presentation.

The advantages of this embodiment also include the gain in time achieved at each transfer operation which leads to an increase in the performance of the machine. Finally, with a machine equipped with the above described subordination means, one is certain of achieving neat work without risk.

What is claimed is:

1. A method of subordinating the orientation of a grab rotatably mounted at the end of a boom supported on the rotatable turret of a Public Works machine, to the rotation of said turret, as a function of the relative locations of loading and unloading zones of said grab and of the axis of rotation of said turret on the frame of said machine, the method being intended to enable presentation of the grab at the said two zones in constant orientations, the method comprising:

choosing three directions, the first direction being determined by the desired orientation of said grab in said loading zone, the second direction being determined by the desired orientation of said grab in said unloading zone, and the third direction passing through said axis of rotation of said turret, measuring the angle of rotation of the turret starting from said third direction and comparing it with the angle between said third direction and a straight line passing through the point of intersection of said first and second directions and through said axis of rotation of said turret, determining the angle which said grab must take up with respect to said boom to remain in one or other of said first and second directions, measuring the angle which said grab actually makes with said boom, comparing it with said determined angle, and controlling the rotation of said grab with respect to said boom in dependence on said comparison to bring said measured angle to equality with said determined angle.

2. A method as claimed in claim 1, wherein said determined angle is calculated by summation of said angle of rotation of said turret and one of the angles which said first and second directions make respectively with said third direction, in dependence on the results of said comparison of said angle of rotation of said turret with the angle between said third direction and said straight line passing through said axis of rotation of said turret and said point of intersection of said first and second directions.

3. A method as claimed in claim 1, wherein said determined angle is determined by selecting its value from at least two values which are predetermined as a function of the results of said comparison of the angle of rotation of said turret with the angle between said third direction and said straight line passing through said axis of rotation of said turret and through the point of intersection of said first and second directions.

4. A method as claimed in claim 3, wherein rotation of said turret is limited to a sector bounded by the two angles that said boom makes with said third direction when said grab is in said loading and unloading zones.

5. A method as claimed in claim 1, wherein said third direction is along the main axis of said frame of said machine.

6. In a Public Works machine for transferring material from a loading zone associated with a first direction to an unloading zone associated with a second direction, and comprising a frame, a turret mounted for rotation on said frame, a boom supported on said turret and carrying at its free end a grab which is mounted to rotate relative thereto, drive means for rotating said turret with respect to said frame and drive means for rotating said grab with respect to said boom, the improvement comprising:

a first pick-up means for generating a signal corresponding to the angle of rotation of said turret with respect to a third direction chosen arbitrarily in the working plane of said machine and passing through the axis of rotation of said turret, means for generating a signal corresponding to the value of the angle between said third direction and a straight line passing through the point of intersection of said first and second directions and said axis of rotation of said turret, a first element for comparing said signal from said first pick-up means with said generated signal and being adapted to emit selectively one of two signals as a result of said comparison, means for generating two signals of predetermined value, the first signal corresponding to the desired angle of orientation of said grab with respect to said boom at said loading zone, the second signal corresponding to the desired angle of orientation of said grab with respect to said boom at said unloading zone, a selector connected to said two signal generating means for emitting a signal selected from said two signals as a function of the value of the signal which it receives from said first comparator element, a second pick-up means for emitting a signal corresponding to the angle of orientation of said grab with respect to said boom, a second element for comparing the signal from said selector and said second pick-up means and emitting a signal for controlling said drive means for rotating said grab with respect to said boom so as to nullify the difference between the two signals which said second element compares.

7. A machine as claimed in claim 6, including means for generating two signals corresponding to the minimum and maximum values of the angle of rotation of said turret measured from said third direction, and a third element for comparing the signal emitted by said first pick-up means with said two signals and for emitting a signal for controlling said drive means for rotating said turret as a function of the results of said comparison.

8. A machine as claimed in claim 6, wherein said selector comprises a logic calculator connected to the outputs of said first comparator element to signal generator means for generating signals, said first signal corresponding to the angle between said first and third directions, the second signal corresponding to the angle between said second and third directions, said calculator selecting one of said two signals as a function of the signal from said first comparator element and emitting an output signal corresponding to the sum of said selected one of said two signals and said signal received from said first comparator element.

* * * * *